United States Patent [19]

Stebbins et al.

[11] Patent Number: 4,487,067

[45] Date of Patent: Dec. 11, 1984

[54] HIGH SPEED SPIN TEST DEVICE

[75] Inventors: Donald E. Stebbins, Dunkirk; Mel Morganstein, Silver Spring, both of Md.

[73] Assignee: The United States of America as represented by the Secretary of the Army, Washington, D.C.

[21] Appl. No.: 520,797

[22] Filed: Aug. 5, 1983

[51] Int. Cl.[3] ..... G01N 33/22; F16H 13/02

[52] U.S. Cl. ..... 73/432 R; 74/206; 73/35

[58] Field of Search ..... 73/432 K, 432 R, 1 DC, 73/35; 74/206, 216

[56] References Cited

U.S. PATENT DOCUMENTS

| | | | |
|---|---|---|---|
| 1,829,311 | 10/1931 | Tea . | |
| 2,301,967 | 11/1942 | Nosker et al. | 73/151 |
| 2,355,092 | 8/1944 | Meister | 73/51 |
| 2,631,453 | 3/1953 | Larsen et al. | 73/147 |
| 2,655,033 | 10/1953 | Burrell | 73/1 |
| 2,799,163 | 7/1957 | Armstrong et al. | 73/167 |
| 2,882,717 | 4/1959 | Brow | 73/1 DC |
| 2,947,580 | 8/1960 | Fisher | 74/206 X |
| 3,183,730 | 5/1965 | Scragg et al. | 74/206 |
| 3,233,398 | 2/1966 | Gilchrist | 74/206 X |
| 3,718,050 | 2/1973 | Verhellen | 74/206 |
| 3,745,832 | 7/1973 | Johnson | 73/432 K |
| 3,847,027 | 11/1974 | Baily | 74/190 |

*Primary Examiner*—James J. Gill

*Attorney, Agent, or Firm*—Anthony T. Lane; Robert P. Gibson; Saul Elbaum

[57] ABSTRACT

A rotatably shaft is directly supported by at least three wheels, including a drive wheel. The circumferential edge of each of the wheels frictionally engages the circumferential edge of the shaft. The shaft is in frictional contact with each of the wheels, and is driven by the drive wheel. Speed step up is achieved because the diameter of the drive wheel is larger than the diameter of the shaft.

11 Claims, 6 Drawing Figures

HIGH SPEED SPIN TEST DEVICE

RIGHTS OF THE GOVERNMENT

The invention described herein may be manufactured and used by or for the United States Government for government purposes without payment to us of any royalty thereon.

BACKGROUND OF THE INVENTION

The present invention relates to equipment for spin testing objects, such as ordnance fuse components, about a given axis of rotation. In the case of ordnance fuse components, the axis is usually equivalent to the longitudinal axis of some projectile; and the spin rate is equal to that of the projectile during flight. Such equipment is necessary to simulate flight spin conditions in the laboratory environment so that the component may be monitored during spin and/or the component may be readily inspected after spin. Flight testing is not a satisfactory method of testing these components, because it is difficult to monitor the component during flight, and because it may not permit consistent recovery of the projectile and, thus, the component in question.

Various types of ordnance projectiles experience spin rates in excess of 500 revolutions per second (rps). It has heretofore been extremely difficult—or even impossible—to build spin test equipment capable of attaining or exceeding 500 rps. This has been due to the design limitations imposed by bearings, drive systems, and speed step-up systems.

With respect to bearings, when the rotating member that contains the component to be tested is directly supported by bearings, the bearings will work at a differential speed rate which is exactly the same as the member itself. The spin rate capability of a given bearing is dependent on both its size and its design. The smaller the bearing, the greater is its spin rate capability; due, in part, to the lower linear speed and, in part, to lower centrifugal force imposed on the bearing components. However, greater spin rate capability is only obtained at the sacrifice of the bearings and inherent load carrying capability, both in the longitudinal direction (thrust) and in the radial direction (lateral load). Higher precision bearings or so-called high speed bearings will allow somewhat higher speeds, but, for a given size, this is by no means significant when compared to off the shelf bearings. Higher speed designs, further, will often require sophisticated and expensive cooling and lubrication systems, and, most often, provide the higher spin capability at an even further reduction inherent load carrying capability. The highest spin rate bearings are usually of the fluid type which support the spinning member on a fluid cushion subjected to shear. For example, air bearings are capable of extremely high spin rates (over 1000 rps) but at the cost of having negligible load bearing carrying capability.

There are no motor devices with sufficient power capable of direct spin rates on the order of 1000 rps except for gas or air turbines. Electric motors of sufficient power will "throw" the windings at these speeds. Piston or other forms of external/internal combustion engines also fly apart at these speeds. Large turbines of sufficient torque impose significant problems in the area of noise, safety, and the provision of sufficient drive fluid from either combustors or compressed gas tanks.

Smaller turbines may not be capable of sufficient torque and cannot handle the lateral and thrust loadings.

Speed step-up systems or drives to obtain the requisite output speed are, generally, not acceptable. A belt drive system can impose significant side loadings on support bearings which may already be marginal. Further, centrifugal forces are imposed which may destroy the drive belt in short order. Gear trains create significant drag, may impose significant side loading, and, generally, are not suitable for these spin rates.

SUMMARY OF THE INVENTION

Briefly, in accordance with the invention, a device for supporting and rotating a shaft at very high speeds is provided. A rotatable shaft having a circular cross-section and longitudinal axis of rotation is directly supported by a set of at least three circular wheels including a drive wheel. The circumferential edge of each of the wheels frictionally engages the circumferential edge of the shaft. The drive wheel has a constant diameter larger than the diameter of the circular cross-section of the shaft where the drive wheel engages the shaft. Means are supplied to rotatably support the wheels. Means are also supplied to drive the drive wheel.

It is an object of this invention to provide a high speed spin test device in which the bearings and drive motor are not subjected to high spin rates.

It is a further object to provide a high speed spin test device which does not use belts or gear drives.

It is a further object of this invention to provide a high speed spin test device which does not require bearing cooling or lubrication systems.

It is a further object of this invention to provide a high speed spin test device which is simple, inexpensive, easily maintainable, quiet in operation, and highly reliable.

DESCRIPTION OF A PREFERRED EMBODIMENT

Figure 1:
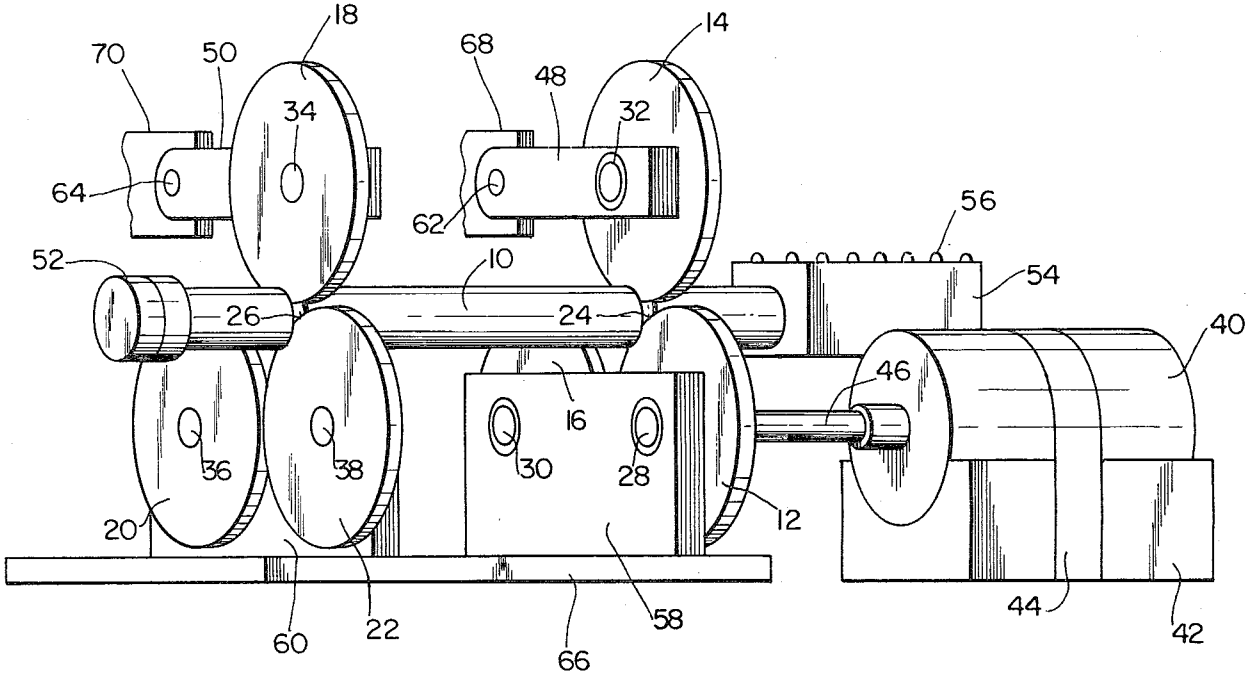
FIG. 1 illustrates a plane view of the preferred embodiment of the invention.

In the preferred embodiment of the invention, illustrated by FIG. 1, a hollow rotatable shaft 10 having a circular cross section and longitudinal axis of rotation is shown. Shaft 10 has two circular bottomed circumferential grooves, 24 and 26, cut in it. A first set of three coplanar circular wheels, 14, 16, and circular drive wheel 12, engage shaft 10 at circumferential groove 24. A second set of three circular wheels 18, 20, and 22, engage shaft 10 at the second circumferential groove 26. Each set of wheels is distributed around the shaft so that it is directly supported. The circumferential edge of each of the wheels is rounded so as to match the circular bottomed grooves 24 and 26 cut in shaft 10. The purpose of the rounded wheel edges and the grooves are to prevent the shaft from wandering along its longitudinal axis and to provide slightly greater surface area at the point where the wheels frictionally engage the shaft.

Circular wheels 12, 14, 16, 18, 20, and 22, are each connected by a shaft, not shown, to bearings 28, 30, 32, 34, 36 and 38, respectively. Bearings 28 and 30 are mounted on bearing support 58. Bearings 36 and 38 are mounted on bearing support 60. Bearings supports 58 and 60 are mounted on base 66. Bearing 32 is mounted on pivot arm 48, and bearing 34 is mounted on pivot arm 50. Pivot arm 48 is connected to pivot arm support 68 by a bolt 62. Pivot arm 50 is connected to pivot arm support 70 by a bolt 64. The purpose of the pivot arms is to keep shaft 10 in place and to provide additional pressure for the friction drive.

Circular drive wheel 12 is connected to motor drive shaft 46. Motor drive shaft 46 is driven to electric motor 40. The motor 40 is mounted on motor mounting base 42 and held down by strap 44. A specimen test receptacle 52 is mounted at one end of shaft 10 to hold components to be spin tested. A slip ring and brush apparatus 54 is provided on the other end of shaft 10. Electrical contacts 56 are provided on the slip ring and brush apparatus 54 for monitoring electrical information.

In operation motor 40 drives motor shaft 46, which in turns drives circular drive wheel 12. Shaft 10 is directly driven by circular drive wheel 12 because they are in direct frictional contact with each other at circumferential groove 24. Since the diameter of the shaft is less than that of the drive wheel where the drive wheel engages the shaft, the shaft must run at a rotational rate higher than that of the drive wheel, its relative spin rate being equivalent to the ratio of the two respective radii. For example, if the wheel radius to shaft radius ratio is 5.625 to 1, and the wheels, the motor, and the bearings run at 178 rps, the shaft will be stepped up to 1001 rps. The ratio of 5.625 to 1 is approximately the highest ratio obtainable without occurring interference between the wheels themselves.

Figure 2:
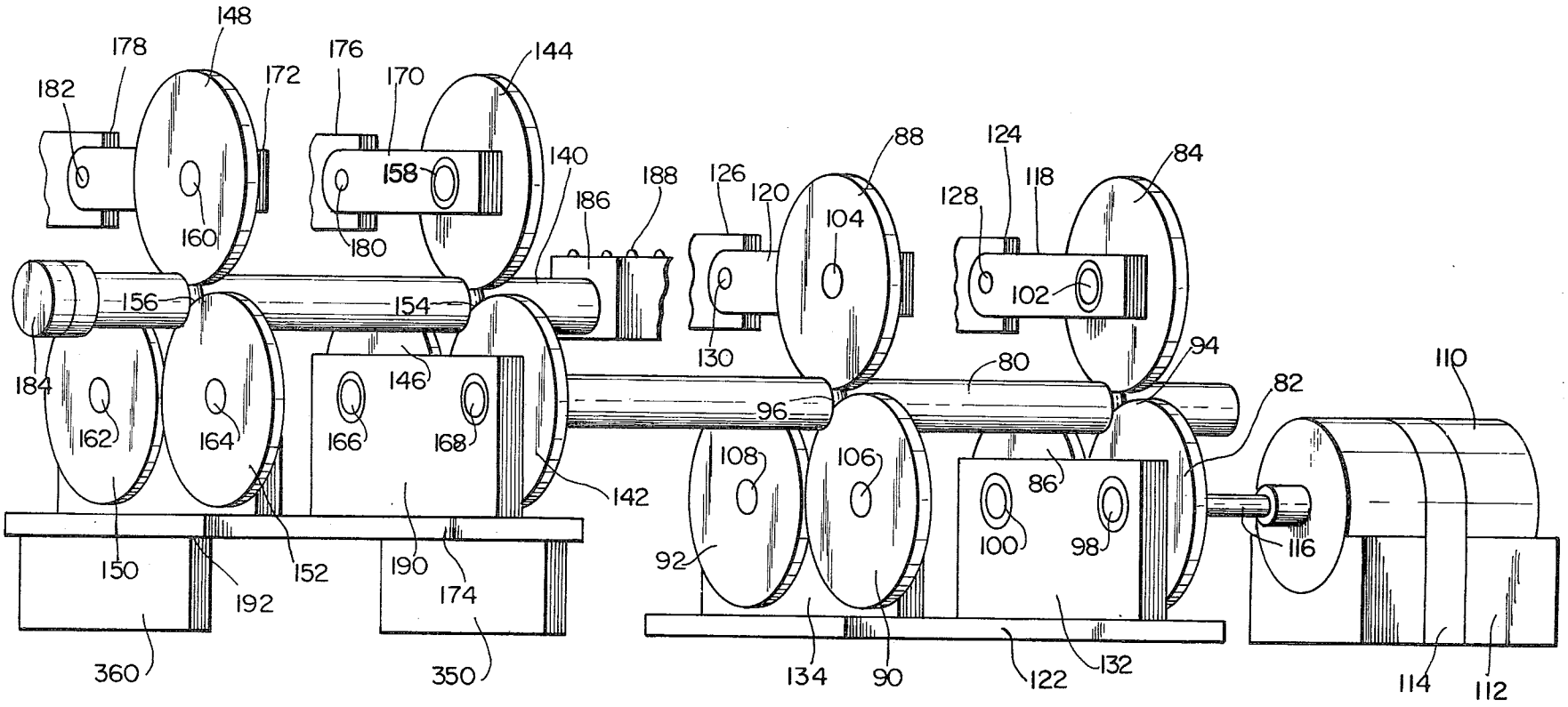
FIG. 2 illustrates a plane view of two systems cascaded in series.

FIG. 2 shows two systems cascaded together. A first rotatable shaft 80 with circular cross section and longitudinal axis of rotation has two circular bottomed circumferential grooves 94 and 96 cut in it. Circular wheels 84, 86, and first circular drive wheel 82 engage shaft 80 at groove 94. Circular wheels 88, 90, and 92 engage shaft 80 at circumferential groove 96. Circular wheels 82, 84, 86, 88, 90, and 92, are connected by a shaft not shown, to bearings 98, 102, 100, 104, 106, and 108, respectively. Bearings 98 and 100 are supported by bearing support 132. Bearings 106 and 108 are supported by bearing support 134. Bearing supports 132 and 134 are attached to base 122. Bearing 102 is attached to pivot arm 118, and bearing 104 is attached to pivot arm 120. Pivot arm 118 is attached to pivot arm support 124 by bolt 128. Pivot arm 120 is attached to pivot arm support 126 by bolt 130. Motor drive shaft 116 directly connects motor 110 to drive wheel 82. Electric motor 110 is mounted on base 112 that is secured by strap 114.

Shaft 80 is directly connected to second circular drive wheel 142. This circular drive wheel frictionally engages a second hollow rotatable shaft 140 with circular cross section and longitudinal axis of rotation. Shaft 140 has two circular bottomed circumferential grooves 154 and 156 cut in it. Circular wheels 144 and 146 and second circular drive wheel 142 engage shaft 140 at groove 154. Circular wheels 148, 150, and 152 engage shaft 140 at groove 156. Circular wheels 142, 144, 146, 148, 150, and 152, are connected by a shaft, not shown, to bearings 168, 158, 166, 160, 162, and 164, respectively. Bearings 166 and 168 are mounted on bearing support 190. Bearings 162 and 164 are mounted on bearing support 192. Bearing supports 190 and 192 are mounted on base 174 and base 174 is mounted on base supports 350 and 360. Bearing 158 is mounted on pivot arm 170, and bearing 160 is mounted on pivot arm 172. Pivot arm 170 is attached to pivot arm support 176 by bolt 180. Pivot arm 172 is attached to pivot arm support 178 by bolt 182. A specimen test receptacle 184, for holding objects to be spin tested, is attached to one end of shaft 140. A slip ring and brush apparatus 186 is attached to the other end of shaft 140. Electrical contacts 188 are provided on slip ring and brush apparatus 186 for monitoring electrical information.

First drive wheel 82 has a constant diameter larger than the diameter of the circular cross section of shaft 80 where the drive wheel engages the shaft. Drive wheel 142 has a constant larger than the diameter of the circular cross section of shaft 140 where the drive wheel engages the shaft. In operation motor 110 drives drive wheel 82, which in turn frictionally drives shaft 80. Shaft 80 drives drive wheel 142 which in turn frictionally drives shaft 140. Speed step up is achieved because the diameter of the drive wheels is larger than the diameter of the shafts. As an example, if the ratio of the first drive wheel to the first shaft is 5.625 to 1, in the ratio of the second drive wheel to the second shaft is also 5.625 to 1, then the speed step up ratio is about 31.5421 to 1.

Figure 3:
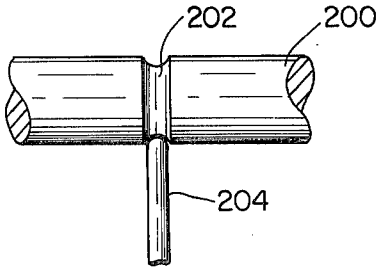
FIG. 3 illustrates a wheel with a rounded edge engaging a matching circumferential groove cut in the shaft.

FIG. 3 show a cross section of a rotatable shaft 200. A circular bottomed circumferential groove 202 is cut in the shaft. Circular wheel 204 has its circumferential edge rounded to match groove 202. The groove and the matching wheel prevents the shaft from wandering along its longitudinal axis, and also acts to increase area of frictional contact between the shaft and the wheel.

Figure 4:
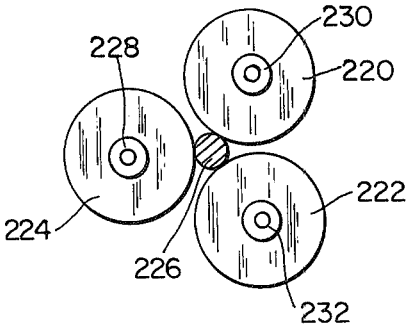
FIG. 4 illustrates a cross-sectional view of the shaft supported by three coplanar wheels.

FIG. 4 shows coplanar circular wheels, 220, 222, and 224 surrounding and supporting a section of a rotatable shaft 226. Wheels 220, 222, and 224 are connected to shafts 228, 230 and 232, respectively; and each shaft is supported by a bearing, not shown. Alternatively, all three coplanar wheels could engage a shaft in a circumferential groove.

Figure 5:
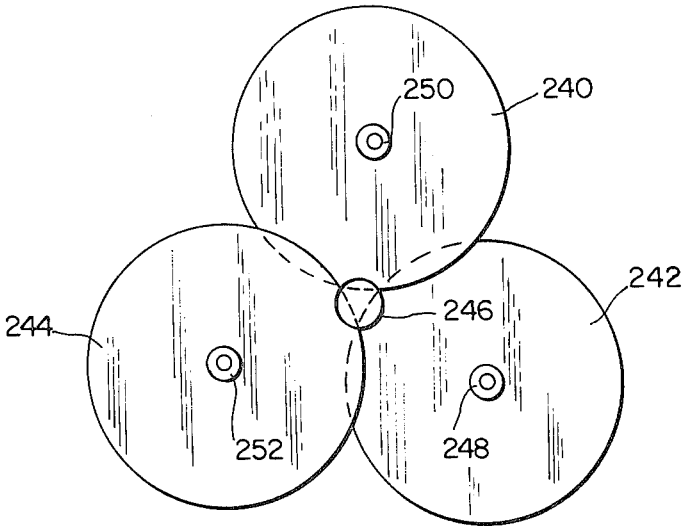
FIG. 5 illustrates three overlapping wheels engaging the shaft and wheels.

FIG. 5 illustrates three circular wheels, 240, 242, and 244 engaging the shaft, 246, at three different grooves. Wheels 240, 242, and 244 are connected to shafts 248, 250 and 252, respectively; and each shaft is supported by a bearing not shown. This configuration allows a shaft to be stepped up to even higher speeds, because large diameter wheels can be used without having the wheels contact one another.

Although each possible combination of wheels and shafts cannot be shown, it should be understood that we do not wish to limit our invention to the embodiment shown herein. Our invention is not limited to sets of three wheels each; any number of wheels above three can be used to rotatable support the shaft. Further, any number of shafts can be cascaded together.

Figure 6:
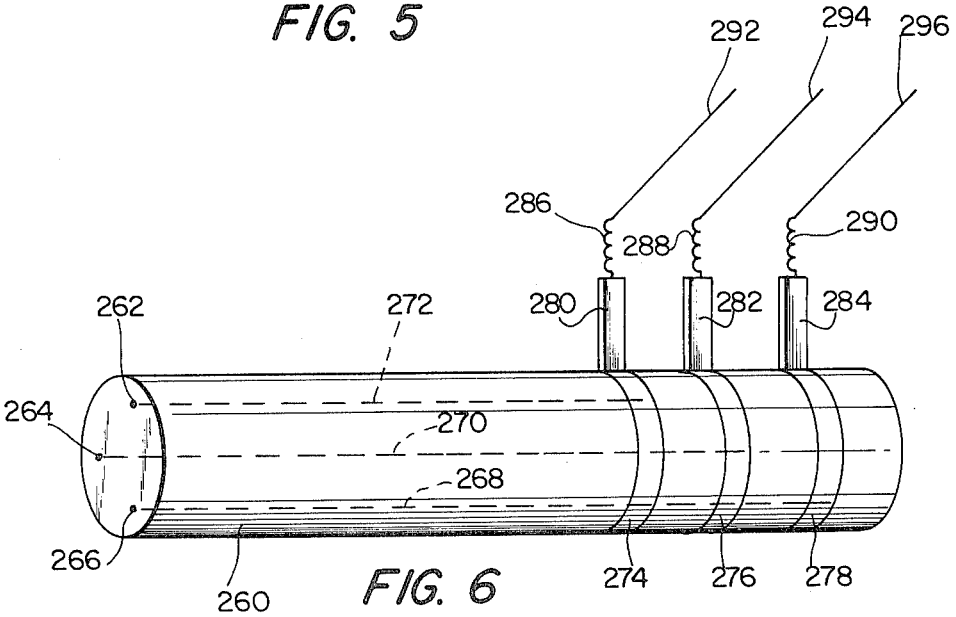
FIG. 6 illustrates a view of the electrical take-off means of the device disclosed in FIG. 1.

FIG. 6 illustrates a slip ring brush assembly used to take off electrical information from objects to be spin tested which contain electrical components. Shaft 260 is hollow and contains wires 268, 270, and 272. The wires terminate on one of the shaft and contacts: wire 268 terminates at contact 266; wire 270 terminates at contact 264; and wire 272 terminates at contact 262. Each wire is also connected to a slip ring at the other end of the shaft: wire 268 is connected to slip ring 278; wire 270 is connected to slip ring 276; and wire 272 is connected to slip ring 274. Each contact, each wire, and each slip ring is electrically insulated from each other. Although only three sets of contacts, wires, and brushes is shown, any number could be used.

External electrical connection between the electrical components and the object to be tested and the slip rings is maintained by the use of conducting brushes resiliently urged against the slip rings. Conducting spring 286 urges conducting brush 280 against slip rings 274. Conducting spring 288 urges conducting brush 282 against slip ring 276. Conducting spring 290 urges conducting brush 284 against slip ring 278. Wires 292, 294, and 296, are electrically connected to springs 286, 288, and 290, respectively.

In another embodiment, not shown, the object to be rotated contains electrical components including means to telemeter the condition of the electrical components. A radio receiver would be used to pick up the telemetry signals. This embodiment may not require slip rings or brushes.

While the invention has been described with reference to the accompanying drawings, we do not wish to be limited to the details shown therein as obvious modifications may be made by one of ordinary skill in the art.

We claim:

1. A device for supporting and rotating a shaft at very high speeds, comprising:

a. a first rotatable shaft having a circular cross section and longitudinal axis of rotation;

b. a first set of at least three circular wheels including a drive wheel;

c. the circumferential edge of each of said wheels being frictionally engaged with the circumferential edge of the shaft;

d. said wheels being distributed around the shaft so as to directly support it;

e. said drive wheel having a constant diameter larger than the diameter of the circular cross section of the shaft where the drive wheel engages the shaft;

f. means to rotatably support said wheels;

g. means to drive said drive wheel;

h. a second rotatable shaft having a circular cross section and longitudinal axis of rotation;

i. a second set of at least three circular wheels including a second drive wheel;

j. the circumferential edge of each wheel of said second set being frictionally engaged with the circumferential edge of said second shaft;

k. said second set of wheels being distributed around the second shaft so as to directly support it;

l. said second drive wheel having a diameter larger than the diameter of the circular cross section of the second shaft where it engages the second shaft;

m. means to rotatably support said second set of wheels; and n. means to connect said second drive wheel to said first shaft.

2. The device of claim 1 wherein:

(a.) said first shaft has at least one circumferential groove cut in it; and (b.) at least one wheel of said first set of wheels directly engages said first shaft at at least one of the circumferential grooves so as to prevent lateral movement of the shaft.

3. The device of claim 1 wherein:

a. said second shaft has at least one circumferential groove cut in it;

b. at least one wheel of said second set of wheels directly engages said second shaft at at least one of the circumferential grooves so as to prevent lateral movement of the shaft.

4. The device of claim 1 further comprising means to urge said wheels against the shaft.

5. The device of claim 1 wherein the means to rotatably support said wheels comprises bearings.

6. The device of claim 5 wherein said bearings are respectively connected to one or more means for pivotally urging said wheels against said shaft.

7. The device of claim 1 further comprising means connected to said second shaft for holding an object to be rotated.

8. The device of claim 7 wherein said object to be rotated contains electrical components including take-off means operatively connected to said object for maintaining external electrical connections to said components.

9. The device of claim 8 wherein said take-off means comprises a plurality of connector rings insulated from each other on said shaft, means for electrically connecting said connector rings to electrical components within said object, and brush means resiliently urged against said connector rings for maintaining external connections to said electrical components with said object.

10. The device of claim 7 wherein said object to be rotated contains electrical components including means to telemeter the condition of said electrical components.

11. The device of claim 1 wherein said means to drive said drive wheel comprises an electric motor connected to said drive wheel.

* * * * *